US011322132B2

(12) United States Patent
Frank et al.

(10) Patent No.: US 11,322,132 B2
(45) Date of Patent: May 3, 2022

(54) ENGINE SOUND ENHANCEMENT

(71) Applicant: Toyota Motor Engineering & Manufacturing North America, Inc., Plano, TX (US)

(72) Inventors: Michael U. Frank, Saline, MI (US); Scott W. Shopoff, Ypsilanti, MI (US); Keita Okamoto, Peachtree City, GA (US); Shigeki Yoshida, Peachtree City, GA (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 0 days.

(21) Appl. No.: 16/995,554

(22) Filed: Aug. 17, 2020

(65) Prior Publication Data

US 2022/0051653 A1 Feb. 17, 2022

(51) Int. Cl.

| | |
|---|---|
| ***G10K 15/02*** | (2006.01) |
| ***H04R 1/02*** | (2006.01) |
| ***H04R 3/00*** | (2006.01) |

(52) U.S. Cl.

CPC ..... *G10K 15/02* (2013.01); *H04R 1/025* (2013.01); *H04R 3/00* (2013.01); *H04R 2430/01* (2013.01); *H04R 2499/13* (2013.01)

(58) Field of Classification Search

CPC ..... H04R 1/025; H04R 3/00; H04R 2430/01; H04R 2499/13; G10K 15/02; F02M 35/1294

See application file for complete search history.

(56) References Cited

U.S. PATENT DOCUMENTS

| | | | | |
|---|---|---|---|---|
| 7,088,829 | B1 * | 8/2006 | Schick | B60Q 5/00 381/61 |
| 7,464,674 | B2 | 12/2008 | Michelini et al. | |
| 7,694,660 | B2 | 4/2010 | Koss | |
| 8,325,932 | B2 | 12/2012 | Maeda | |
| 9,261,031 | B2 | 2/2016 | Watanuki et al. | |
| 9,536,510 | B2 | 1/2017 | Christoph | |
| 9,682,652 | B2 | 6/2017 | Bailey, III et al. | |
| 9,815,404 | B2 | 11/2017 | Peachey et al. | |
| 10,071,686 | B2 | 9/2018 | Reilly et al. | |
| 10,377,306 | B2 | 8/2019 | Hera | |
| 10,384,599 | B2 | 8/2019 | Tanaka | |
| 10,414,337 | B2 | 9/2019 | Kreifeldt et al. | |
| 10,418,022 | B2 | 9/2019 | Niibe et al. | |

(Continued)

*Primary Examiner* — Jason R Kurr

(74) *Attorney, Agent, or Firm* — Snell & Wilmer LLP

(57) ABSTRACT

Methods, systems, devices and apparatuses for a sound enhancement system. The sound enhancement system includes an airflow sensor. The airflow sensor is configured to measure an airflow into an engine of the vehicle. The sound enhancement system includes an electronic control unit. The electronic control unit is coupled to the airflow sensor. The electronic control unit is configured to determine a time of when to output an audio signal that mimics or enhances engine sound based on the airflow into the engine of the vehicle. The electronic control unit is configured to generate the audio signal based on the airflow into the engine of the vehicle. The sound enhancement system includes an audio device. The audio device is configured to output the audio signal based on the timing of when to output the audio signal.

20 Claims, 6 Drawing Sheets

(56) References Cited

U.S. PATENT DOCUMENTS

| | | | | |
|---|---|---|---|---|
| 10,473,048 | B2 | 11/2019 | Moorcroft | |
| 2009/0066499 | A1 | 3/2009 | Bai et al. | |
| 2009/0314241 | A1 | 12/2009 | Koss et al. | |
| 2012/0177214 | A1* | 7/2012 | Hera | G10K 15/02 381/73.1 |
| 2013/0294619 | A1* | 11/2013 | Valeri | G10K 15/02 381/86 |
| 2019/0256016 | A1* | 8/2019 | Valeri | H04R 3/00 |

* cited by examiner

ENGINE SOUND ENHANCEMENT

BACKGROUND

Field

This disclosure relates to a system, method, apparatus and/or device to output a natural engine sound of a vehicle.

Description of the Related Art

As vehicles become more fuel efficient, engine noise has decreased significantly. Engine noise, however, may be a desirable characteristic to some vehicle owners. Some drivers want the torque and fuel efficiency of a newer and better engine, but also want to keep the classic sound of an older gas combustion engine. This presents various challenges, and vehicle manufacturers must work to distinguish and suppress some types of noise but allow and even enhance other types of noises.

An Engine Sound Enhancement System (ESE) enhances or amplifies the vehicle's engine and exhaust sounds using the audio system. The sounds may or may not pre-recorded. The sounds may further enhance the sounds the vehicle makes to get the aural pleasure of hearing the mechanics growl when the vehicle accelerator pedal is depressed. This gives the driver a better feel for the engine and helps the driver shift by ear.

Current Engine Sound Enhancement (ESE) systems use the vehicle accelerator pedal position as an input. This can create an unnatural engine sound during transient events, such as during paddle shifting or aggressive transmission shifting. Moreover, this can create the unnatural engine sound during aggressive pedal shifting.

Accordingly, there is a need for a system, apparatus and/or method to improve the operation of a sound enhancement system to better mimic or enhance the engine sound of the vehicle so that the engine sound is more natural.

SUMMARY

In general, one aspect of the subject matter described in this disclosure may be embodied in an engine sound enhancement system ("sound enhancement system"). The sound enhancement system includes an airflow sensor. The airflow sensor is configured to measure an airflow into an engine of the vehicle. The sound enhancement system includes an electronic control unit. The electronic control unit is coupled to the airflow sensor. The electronic control unit is configured to determine a time of when to output an audio signal that mimics or enhances the engine sound based on the airflow into the engine of the vehicle. The electronic control unit is configured to generate the audio signal based on the airflow into the engine of the vehicle. The sound enhancement system includes an audio device. The audio device is configured to output the audio signal based on the timing of when to output the audio signal.

These and other embodiments may optionally include one or more of the following features. The sound enhancement system may include a speed sensor. The speed sensor is configured to measure a rotation speed of the engine of the vehicle. The sound enhancement system includes a throttle sensor. The throttle sensor is configured to detect a position of an engine throttle. The electronic control unit is configured to generate that audio signal further based on the rotation speed of the engine and the position of the engine throttle.

The sound enhancement system may include an accelerator pedal sensor. The accelerator pedal sensor may be configured to measure a position of an accelerator pedal of the vehicle. The electronic control unit may be configured to generate the audio signal further based on the position of the accelerator pedal.

The sound enhancement system may include one or more paddle shifters. The one or more paddle shifters may be configured to upshift or downshift to a gear of a transmission of the vehicle into a shift position. The electronic control unit may be configured to generate the audio signal further based on the shift position.

The sound enhancement system may determine a magnitude of the audio signal. An increase in the airflow into the engine may correspond to an increase in the magnitude of the audio signal. A decrease in the airflow into the engine may correspond to a decrease in the magnitude of the audio signal. The audio device may be a speaker. The speaker may be positioned in an interior of the vehicle and the speaker may be configured to output the audio signal into the interior of the vehicle. An increase in the magnitude of the audio signal may correspond to an increase in volume of the outputted sound. A decrease in the magnitude of the audio signal may correspond to a decrease in the volume of the outputted sound.

The sound enhancement system may determine an amount or a rate of the airflow that enters the engine. The sound enhancement system may determine that the audio signal should be outputted when the amount or the rate of the airflow exceeds a threshold amount or rate. The audio signal may be generated independently of a depression of an accelerator pedal of the vehicle.

In another aspect, the subject matter may be embodied in a sound enhancement system for a vehicle. The sound enhancement system includes an airflow sensor. The airflow sensor is configured to measure an airflow into an engine of the vehicle. The engine sound enhancement system includes an electronic control unit. The electronic control unit is coupled to the airflow sensor and is configured to determine a magnitude of an audio signal that mimics or enhances engine sound of the vehicle to be outputted based on the airflow into the engine. The electronic control unit is configured to determine a timing of when to output the audio signal based on the airflow into the engine of the vehicle. The electronic control unit is configured to generate the audio signal based on the determined magnitude. The engine sound enhancement system includes a speaker. The speaker is positioned within an interior of the vehicle and is configured to output the audio signal based on the timing of when to output the audio signal.

In another aspect, the subject matter may be embodied in a method for outputting an engine sound. The method includes measuring, using an airflow sensor, an amount or a rate of airflow into an engine of a vehicle. The method includes determining, by a processor, a magnitude of an audio signal that is to be generated and that mimics or enhances engine sound of the vehicle based on the amount or the rate of airflow into the engine. The method includes determining, by the processor, a timing of when to output the audio signal based on the airflow into the engine of the vehicle. The method includes generating, by the processor, the audio signal based on the determined magnitude. The method includes outputting, via a speaker positioned within an interior of the vehicle, the audio signal based on the timing of when to output the audio signal.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

Figure 1:
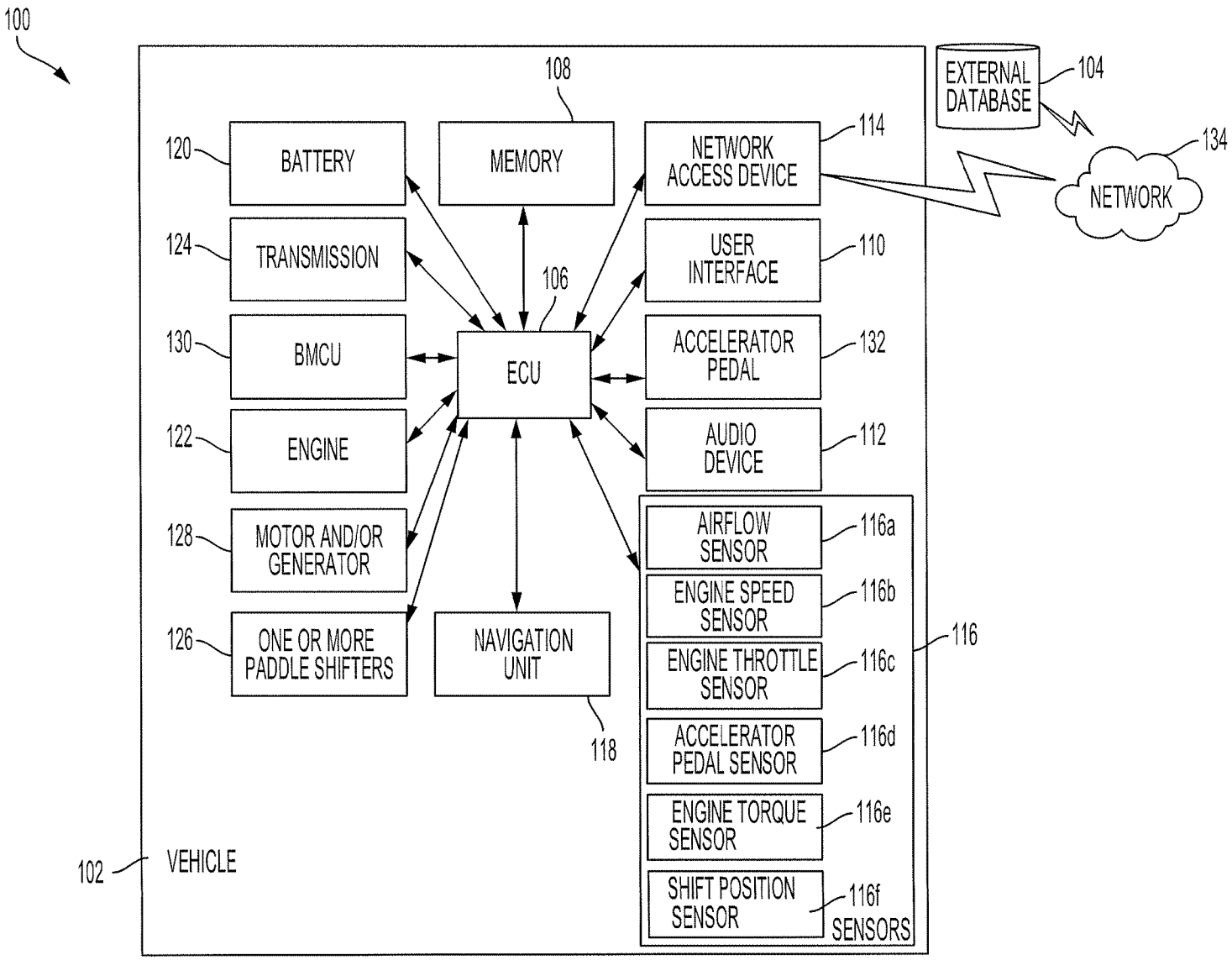
FIG. 1 is a block diagram of an engine sound enhancement system according to an aspect of the invention.

Disclosed herein are systems, apparatuses, and methods for an engine sound enhancement system (or "sound enhancement system") that enhances the sound or other audio generated to mimic the engine sound of the vehicle. The sound enhancement system creates a creates a more natural feeling of the engine sound for various driving patterns. By changing the main input that is used to generate the audio signal to the airflow rate into the engine, the sound enhancement system better matches or synchronizes with the vehicle behavior, such as an acceleration of the vehicle, over time and creates a more natural feeling engine sound.

For example, in a conventional engine sound enhancement system, when the driver accelerates the vehicle from a stopped position, the conventional engine sound enhancement system generates the sound based on a pedal position. And so, the conventional engine sound enhancement system will output a loud engine sound that corresponds to the depressed pedal position even though the vehicle may only slowly accelerate because the vehicle requires time to accelerate from the stopped position. This creates an unnaturally loud and near immediate engine sound because the engine sound is reflective of the depressed position of the accelerator pedal and not the gradually increasing vehicle acceleration. By changing the main input to the airflow rate into the engine, the sound enhancement system will gradually increase the engine sound to match the vehicle behavior over time, such as the gradually increasing acceleration of the vehicle, which creates a more natural engine sound.

Moreover, since the main input is the airflow rate into the engine, the outputted engine sound synchronizes with the vehicle movement. Typically, when the pedal is depressed, there is a delay between when the pedal is depressed, and the wheels of the vehicle move. In a conventional engine sound enhancement system, the sound would be outputted when the pedal was depressed even though little or no movement would be generated. Whereas, the sound enhancement system would delay the output of the engine sound so that the engine sound coincides with the engine torque, which generates power to move the wheels of the vehicle. And so, the engine sound is more natural and better matches the actual movement of the vehicle.

Other benefits and advantages include the capability to account for the upshifting or downshifting of the transmission. The sound enhancement system may use the shift position of the transmission when generating the audio signal that mimics or enhances the engine sound of the vehicle, such as by increasing the volume of the engine sound. By accounting for the shift position of the transmission, the sound enhancement system may adjust the volume of the engine sound that is generated to account for the driver downshifting or upshifting the transmission, which further makes the sound that is generated more natural and reflective of the actual amount of torque that is generated by the engine.

FIG. 1 is a block diagram of an engine sound enhancement system (or "sound enhancement system") 100. The sound enhancement system 100 or a portion thereof may be retro-fitted, coupled to, include or be included within a vehicle 102 or separate from the vehicle 102. The sound enhancement system 100 may use one or more vehicle components of the vehicle 102 to output audio that mimics engine sounds within the interior of the vehicle 102. The sound enhancement system 100 may include or be coupled to an external database 104.

The sound enhancement system 100 may have or use a network 134 to communicate among different components, such as among the vehicle 102 and/or the external database 104. The network 134 may be a Dedicated Short-Range Communication (DSRC) network, a local area network (LAN), a wide area network (WAN), a cellular network, the Internet, or combination thereof, that connects, couples and/or otherwise communicates among the different components of the sound enhancement system 100.

The sound enhancement system 100 may include or be coupled to the external database 104. A database is any collection of pieces of information that is organized for search and retrieval, such as by a computer, and the database may be organized in tables, schemas, queries, reports, or any other data structures. A database may use any number of database management systems. The external database 104 may include a third-party server or website that stores or provides information. The information may include real-time information, periodically updated information, or user-inputted information. A server may be a computer in a network that is used to provide services, such as accessing files or sharing peripherals, to other computers in the network.

The external database 104 may include a sound database. The sound database may include various sounds, which may be downloaded by the sound enhancement system 100. The sound enhancement system 100 may play or use various sounds or audio (hereinafter, referred to as "audio") to mimic or enhance the engine sound. The audio to be used to mimic the engine sound may be based on the type or kind of the vehicle 102. The sound database may also include a mapping or an association between a value indicative of the volume to be outputted and a magnitude of an audio signal to be generated. This allows the user to configure the audio that is generated to be used to mimic or enhance the engine sound.

The sound enhancement system 100 may include, be included within or be retro-fitted to a vehicle 102. A vehicle

102 is a conveyance capable of transporting a person, an object, or a permanently or temporarily affixed apparatus. The vehicle 102 may be a self-propelled wheeled conveyance, such as a car, a sports utility vehicle, a truck, a bus, a van or other motor, battery or fuel cell driven vehicle. For example, the vehicle 102 may be an electric vehicle, a hybrid vehicle, a hydrogen fuel cell vehicle, a plug-in hybrid vehicle or any other type of vehicle that has a fuel cell stack, a motor and/or a generator. Other examples of vehicles include bicycles, trains, planes, or boats, and any other form of conveyance that is capable of transportation. The vehicle 102 may be semi-autonomous or autonomous. That is, the vehicle 102 may be self-maneuvering and navigate without human input. An autonomous vehicle may have and use one or more sensors and/or a navigation unit to drive autonomously.

The sound enhancement system 100 includes one or more processors, such as the electronic control unit (ECU) 106. The one or more processors, such as the ECU 106, may be implemented as a single processor or as multiple processors. For example, the one or more processors may be a microprocessor, data processor, microcontroller or other controller, and may be electrically coupled to some or all the other components within the vehicle 102. The one or more processors may obtain sensor data from one or more sensors to determine when to output the audio that mimics or enhances the engine sound. The sound enhancement system 100 may output the audio into an interior of the vehicle 102. By generating and outputting the audio into the interior of the vehicle 102, the sound enhancement system 100 creates the aural pleasure of hearing the mechanics growl when the vehicle accelerator pedal is depressed when the vehicle 102 begins to accelerate. This gives the driver a better feel for the engine 122 and helps the driver shift by ear.

The memory 108 may be coupled to the ECU 106. The memory 108 may include one or more of a Random Access Memory (RAM), a Read Only Memory (ROM) or other volatile or non-volatile memory. The 108 may be a non-transitory memory or a data storage device, such as a hard disk drive, a solid-state disk drive, a hybrid disk drive, or other appropriate data storage, and may further store machine-readable instructions, which may be loaded and executed by the ECU 106. The memory 108 may store a mapping that between a value indicative of the volume of the audio to be outputted and a magnitude of the audio signal that is generated to mimic or enhance the engine sound.

The sound enhancement system 100 may include a user interface 110. The user interface 110 may be part of the vehicle 102. The user interface 110 may include an input device that receives user input from a user interface element, a button, a dial, a microphone, a keyboard, or a touch screen. The user interface 110 may provide an interface for a user to provide user input. The user input may include one or more configuration settings. The one or more configuration settings may indicate an amount of delay to output the audio so that the audio matches the vehicle behavior, e.g., the engine torque or speed, to create a more a natural sound when the engine is throttled to move the wheels of the vehicle 102. The amount of delay may be a threshold, such as an amount of airflow or a rate of the airflow into the engine of the vehicle 102 that would cause the engine to move the wheels of the vehicle 102.

The user interface 110 may include, provide or be coupled to an output device, such as the audio device 112. The audio device 112 may be a speaker or other audio indicator. The audio device 112 may be positioned within an interior of the vehicle 102. The user interface 110 may include or provide other output devices, such as a display or other visual indicator. The user interface 110 may provide notifications, warnings or alerts, for example.

The sound enhancement system 100 may include a network access device 114. The network access device 114 may include a communication port or channel, such as one or more of a Dedicated Short-Range Communication (DSRC) unit, a Wi-Fi unit, a Bluetooth® unit, a radio frequency identification (RFID) tag or reader, or a cellular network unit for accessing a cellular network (such as 3G, 4G or 5G). The network access device 114 may transmit data to and receive data from the different components the sound enhancement system 100, such as the vehicle 102 and/or the external database 104.

The sound enhancement system 100 may include one or more sensors 116. The one or more sensors 116 may include an airflow sensor 116*a*, an engine speed sensor 116*b*, an engine throttle sensor 116*c* and/or an accelerator pedal sensor 116*d*. The airflow sensor 116*a* may be positioned at an air inlet of the engine 122 and measure an amount of airflow and/or a rate of the airflow into the engine 122. The engine speed sensor 116*b* may measure a rotation speed of the crankshaft of the engine 122. The engine speed sensor 116*b* may measure the revolutions per minute (RPM) of the rotation of the engine crankshaft. The engine throttle sensor 116*c* may measure or determine the throttle position to determine the engine load. The accelerator pedal sensor 116*d* may be coupled to the accelerator pedal 132. The accelerator pedal sensor 116*d* may measure, detect or determine a position of the accelerator pedal 132 to determine the amount that the accelerator pedal 132 of the vehicle 102 is depressed. The one or more sensors 116 may include an engine torque sensor 116*e*. The engine torque sensor 116*e* may measure or determine the torque or the rotational force on the engine 122. The one or more sensors 116 may include one or more other sensors, such as a shift position sensor 116*f* to detect the shift position or the gear position of the transmission 124.

The sound enhancement system 100 may be coupled to one or more vehicle components of the vehicle 102. The one or more vehicle components may include a navigation unit 118. The navigation unit 118 may be integral to the vehicle 102 or a separate unit. The vehicle 102 may include a Global Positioning System (GPS) unit (not shown) for detecting location data including a current location of the vehicle 102 and date/time information instead of the navigation unit 118. In some implementations, the ECU 106 may perform the functions of the navigation unit 118 based on data received from the GPS unit. The navigation unit 118 or the ECU 106 may perform navigation functions. Navigation functions may include, for example, route and route set prediction, providing navigation instructions, and receiving user input such as verification of predicted routes and route sets or destinations. The navigation unit 118 may be used to obtain navigational map information. The navigational map information may include a starting location of the vehicle 102, a current location of the vehicle 102, a destination location, a route between the starting location of the vehicle 102 and the destination location and/or date/time information.

The one or more vehicle components may include a motor and/or generator 128. The motor and/or generator 128 may convert electrical energy into mechanical power, such as torque, and may convert mechanical power into electrical energy. The motor and/or generator 128 may be coupled to the battery 120. The motor and/or generator 128 may convert the energy from the battery 120 into mechanical power, and may provide energy back to the battery 120, for example, via regenerative braking. The one or more vehicle components may include one or more additional power generation devices, such as an engine 122 or a fuel cell stack (not shown). The engine 122 combusts fuel to provide power instead of and/or in addition to the power supplied by the motor and/or generator 128.

The battery 120 may be coupled to the motor and/or generator 128 and may supply electrical energy to and receive electrical energy from the motor and/or generator 128. The battery 120 may include one or more rechargeable batteries and may supply the power to the sound enhancement system 100.

The battery management control unit (BMCU) 130 may be coupled to the battery 120 and may control and manage the charging and discharging of the battery 120. The BMCU 130, for example, may measure, using battery sensors, parameters used to determine the state of charge (SOC) of the battery 120. The BMCU 130 may control the battery 120.

The one or more vehicle components may include a transmission 124. The transmission may have one or more gears, a drivetrain, a clutch and/or a drive shaft. The transmission 124 converts the power from the engine 122 to move the wheels of the vehicle 102. The one or more vehicle components may include one or more paddle shifters 126. The one or more paddle shifters may adjust a shift position of the gears within an automatic transmission. The one or more paddle shifters 126 may be manually depressed, pushed, pulled or otherwise positioned to manually change gears of the transmission 124 electrically.

Figure 2:
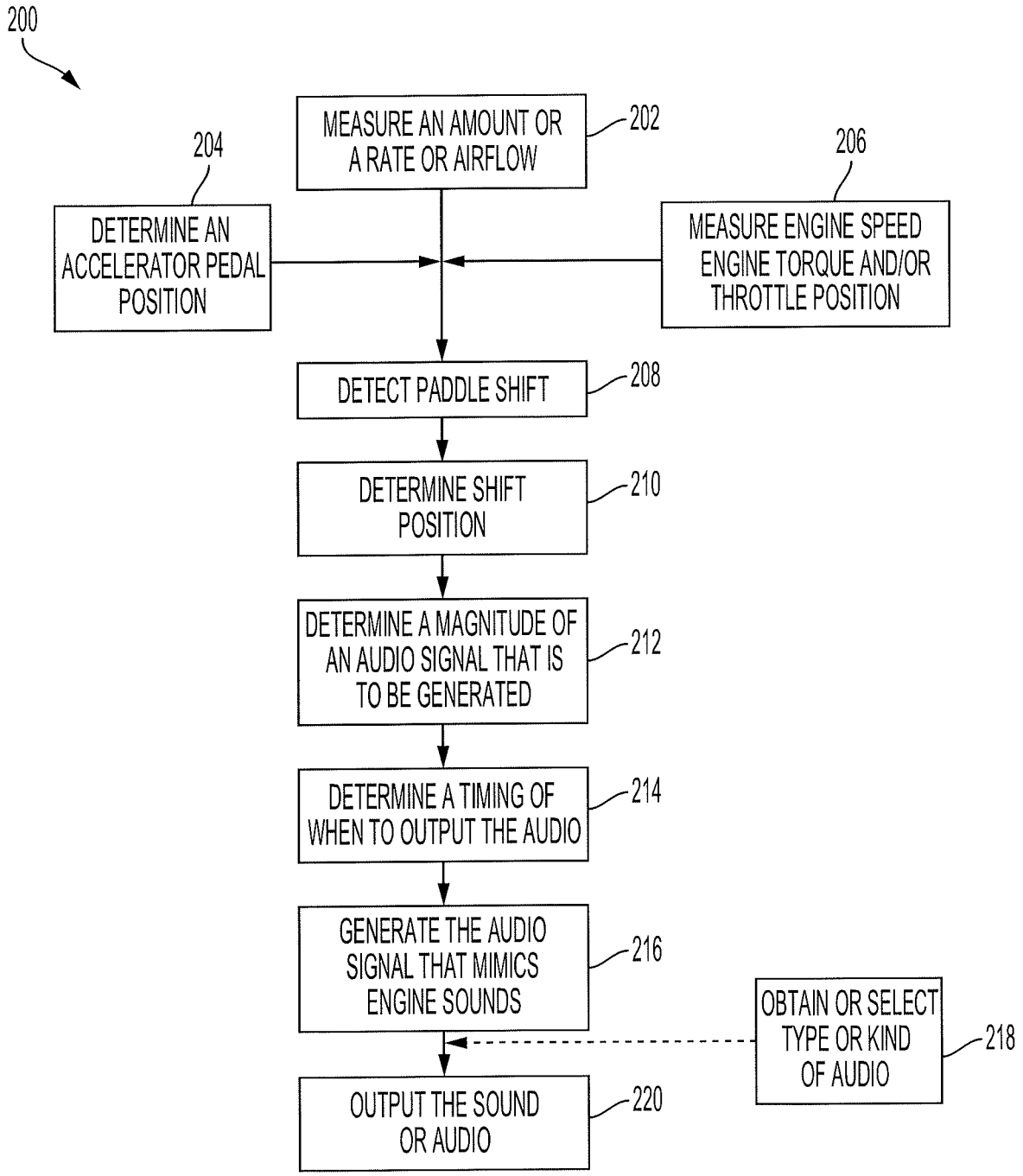
FIG. 2 is a flow diagram of an example process for outputting audio that mimics or enhances the engine sound of the vehicle into an interior passenger cabin of the vehicle using the engine sound enhancement system of FIG. 1 according to an aspect of the invention.

FIG. 2 is a flow diagram of a process 200 for outputting audio that mimics or enhances the engine sound of the vehicle 102. One or more computers or one or more data processing apparatuses, for example, the ECU 106 of the sound enhancement system 100 of FIG. 1, appropriately programmed, may implement the process 200. The sound enhancement system 100 may be used to generate and/or output an audio signal that mimics or enhances the engine sound of the vehicle 102. The sound enhancement system 100 may generate the audio signal and/or further enhance an existing engine sound of the vehicle 102, e.g., by amplifying the magnitude of the existing engine sound of the vehicle 102 or by providing audio that increases the volume of the engine sound of the vehicle 102. The sound enhancement system 100 may use various sensor data, such as the amount or the rate of airflow, the engine speed, the throttle position, the engine torque, the accelerator pedal position and/or a combination thereof, to generate the audio signal that mimics or further enhances the engine sound of the vehicle 102.

The sound enhancement system 100 obtains or measures an amount or a rate of the airflow into the engine 122 of the vehicle 102 (202). The sound enhancement system 100 may use one or more sensors 116, such as the airflow sensor 116*a*, to measure the amount or the rate of the airflow into the engine 122 of the vehicle 102. The airflow sensor 116*a* may be positioned near or in proximity to an air inlet of the engine 122 and measure the airflow over a period. The airflow sensor 116*a* may detect the amount or the rate of the airflow that enters the engine 122. The sound enhancement system 100 may use the amount or the rate of the airflow to determine a timing of when to output the audio to mimic or enhance the engine sound and a volume of the audio to be outputted.

Other sensor data may be collected to assist to enhance or mimic the engine sound of the vehicle 102. The sound enhancement system 100 may determine a position of the accelerator pedal 132 of the vehicle 102 (204). The sound enhancement system 100 may use the accelerator pedal sensor 116*d* to determine the position of the accelerator pedal 132. The accelerator pedal sensor 116*d* may be coupled to the accelerator pedal 132 and may measure the amount and/or rate that the accelerator pedal 132 is depressed and/or released and/or the position of the accelerator pedal 132. The position of the accelerator pedal 132 and/or the amount and/or rate that the accelerator pedal 132 is depressed and/or released may affect the magnitude of the audio signal, and consequently the volume of the audio that is outputted. As an accelerator pedal 132 is depressed further, the engine 122 is further revved, and thus, the audio associated with the engine 122 should be louder. Consequently, the sound enhancement system 100 may increase the magnitude of the audio signal to mimic the engine sound that is representative of the engine 122 that is further revved, and similarly, the sound enhancement system 100 may decrease the magnitude of the audio signal when the accelerator pedal 132 is released.

The sound enhancement system 100 may measure or detect the engine speed, the engine torque and/or the engine throttle position (206). The sound enhancement system 100 may use an engine speed sensor 116*b* to measure the rotation speed of the engine crankshaft. For example, the sound enhancement system 100 may measure the revolutions per minute (RPM) of the engine crankshaft to measure or determine the engine speed. The sound enhancement system 100 may use an engine throttle sensor 116*c* to determine the engine throttle position of the vehicle 102, such as when the throttle is open, partially open and/or closed and the degree that the throttle is open or partially opened. The sound enhancement system 100 may use an engine torque sensor 116*e* to measure or determine the rotational force or torque on the engine 122. The engine speed, the engine torque and/or the engine throttle position may be used to determine the magnitude of the audio signal to be generated to mimic the engine sound of the vehicle 102.

The sound enhancement system 100 may detect a paddle shift (208). The sound enhancement system 100 may detect when the one or more paddle shifters 126 are depressed, pushed, pulled or otherwise toggled. The sound enhancement system 100 may detect which of the one or more paddle shifters 126 are depressed, pushed, pulled or otherwise toggled to upshift or downshift the shift position of the gears of the transmission 124. The input of the one or more paddle shifters 126 may indicate whether the shift position is upshifted or downshifted. Changing the shift position of the transmission 124 of the vehicle 102 changes the gears of the transmission 124. For example, pulling a paddle shifter may upshift the shift position and pushing the paddle shift may downshift the shift position. In another example, moving one paddle shifter may upshift the shift position and moving another paddle shifter may downshift the shift position.

Figure 6:
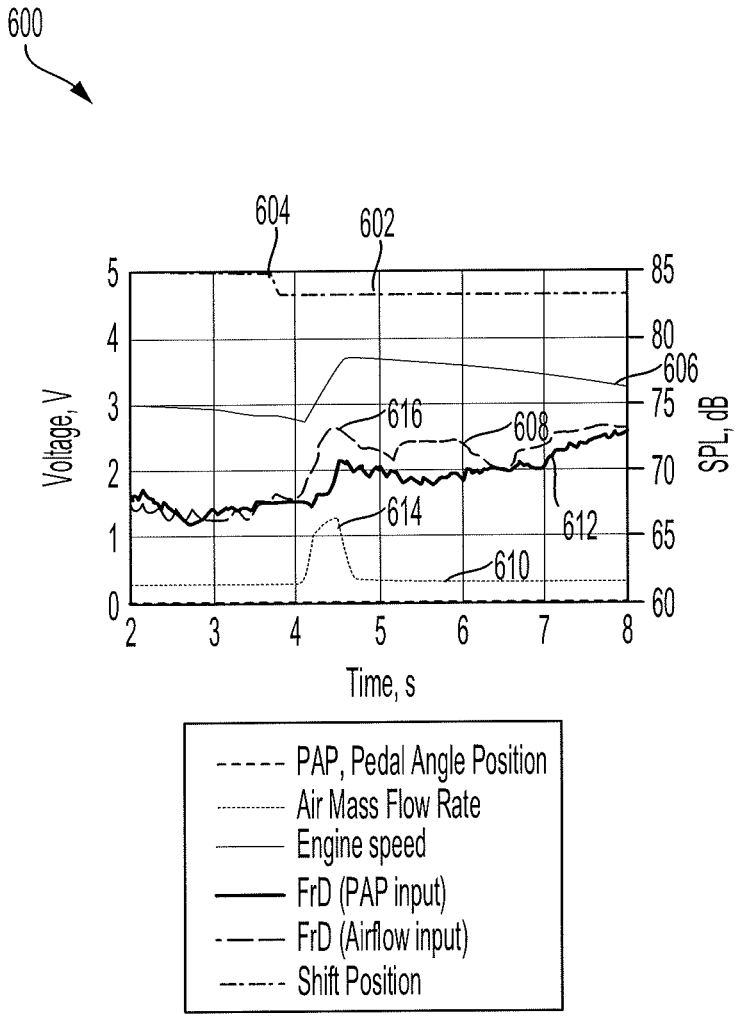
FIG. 6 shows an example graph of the effect of a downshift of the shift position of the transmission of the vehicle on the vehicle behavior using the engine sound enhancement system of FIG. 1 according to an aspect of the invention.

The sound enhancement system 100 may determine the shift position (210). The sound enhancement system 100 may determine the shift position when a paddle shift is detected. The sound enhancement system 100 may use a shift position sensor 116*f* to detect the shift position of the transmission 124. The shift position may affect the amount of airflow into the engine 122 and the engine speed of the vehicle 102, and so, the sound enhancement system 100 may need to adjust the magnitude of the audio signal that is generated, as shown in FIG. 6 for example.

Figure 3:
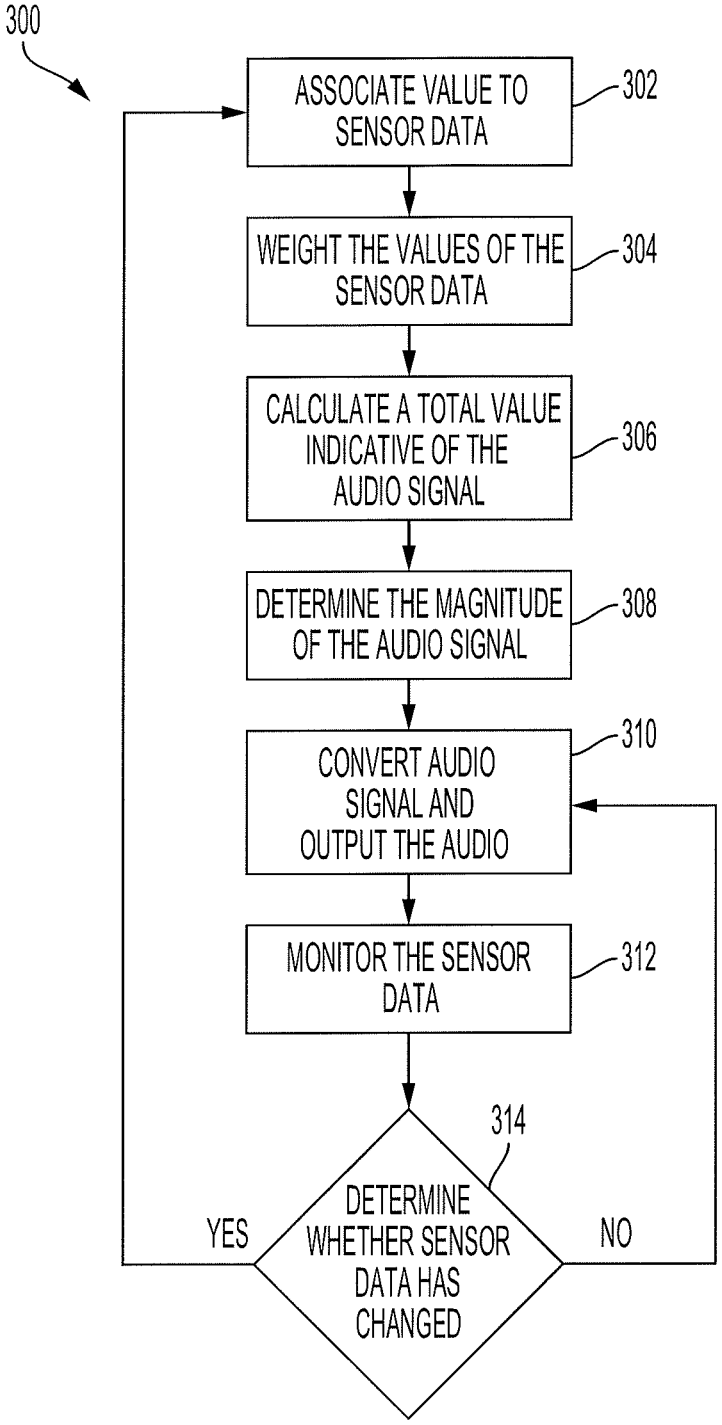
FIG. 3 is a flow diagram of an example process for determining the magnitude of the audio signal, and consequently the volume of the outputted sound using the engine sound enhancement system of FIG. 1 according to an aspect of the invention.

The sound enhancement system 100 determines a magnitude of an audio signal that is to be generated and later converted and outputted as audio to mimic or further enhance the engine sound of the vehicle 102 (212). The sound enhancement system 100 determines the magnitude of the audio signal based on the amount or the rate of the airflow, the engine speed, the engine torque, the engine throttle position, the shift position and/or the accelerator pedal position. The sound enhancement system 100 may use one or a combination thereof of the sensor data to determine the magnitude of the audio signal. For example, the sound enhancement system 100 may use solely the amount or the rate of the airflow to calculate the magnitude of the audio signal or may use a combination thereof to determine the magnitude of the audio signal. The use of the airflow to determine the magnitude of the audio signal may be independent of the other factors, such as the accelerator pedal position. The magnitude of the audio signal corresponds to a volume of the sound of the audio signal emitted from the audio device 112. FIG. 3 further describes the process 300 for determining the magnitude of the audio signal, and consequently, the volume of the outputted sound.

Figure 5:
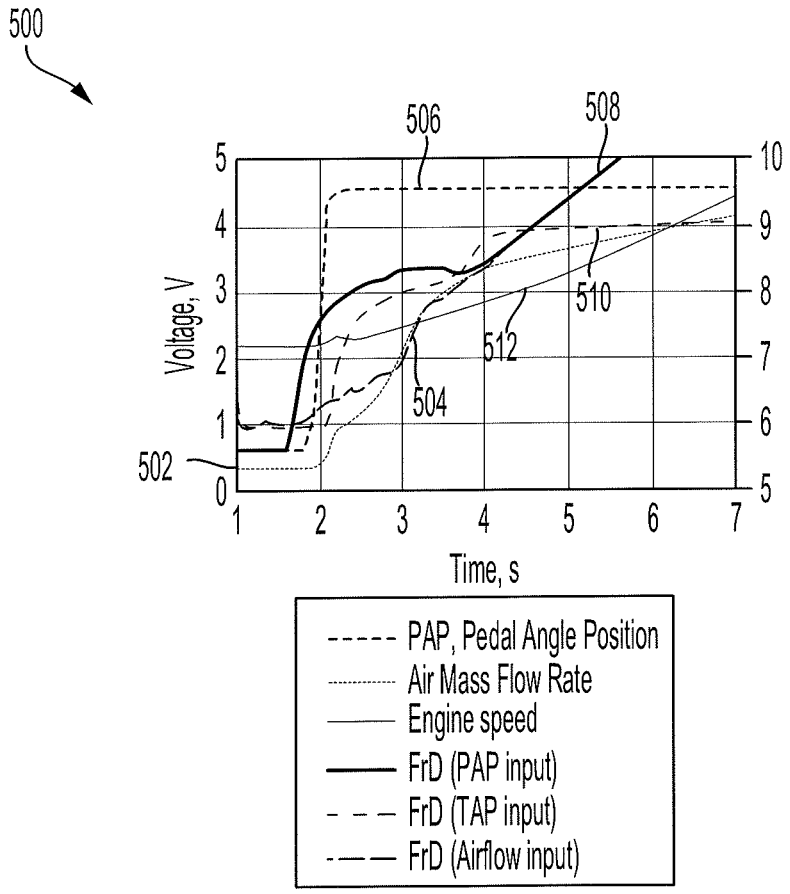
FIG. 5 shows an example graph comparing various sensor data, which may be used by the engine sound enhancement system of FIG. 1 to output the audio that mimics or enhances the engine sound, to the airflow that enters the engine, according to an aspect of the invention.

Once the magnitude of the audio signal is determined, the sound enhancement system 100 may determine a timing of when to output the audio (214). The sound enhancement system 100 may determine when to output the audio signal so that the output of the audio coincides with the throttling of the engine so that the outputted audio mimics or further enhances the engine sound of the vehicle 102 and forms a natural sound that coincides with the throttling of the engine and movement of the vehicle 102. The timing of when to output the audio may be based on the sensor data, such as the amount or the rate of the airflow, the engine speed, the engine torque, the engine throttle position, the shift position and/or the accelerator pedal position. In particular, the sound enhancement system 100 may use the amount or the rate of the airflow to determine the timing because the airflow more closely corresponds, coincides or matches the vehicle behavior and response. For example, if the sound enhancement system 100 were to rely solely on the accelerator pedal, engine torque, engine speed and/or engine throttle positions, the output of the audio would not match the vehicle response, and instead, the audio would be outputted prior to the vehicle moving, as shown in FIG. 5 for example. By using the airflow measurements, the timing may more closely coincide with the vehicle behavior such that the sound enhancement system 100 outputs the audio to match the vehicle behavior, e.g. when the amount and/or rate of airflow is greater than or equal to a threshold amount to move the wheels of the vehicle 102.

Figure 4:
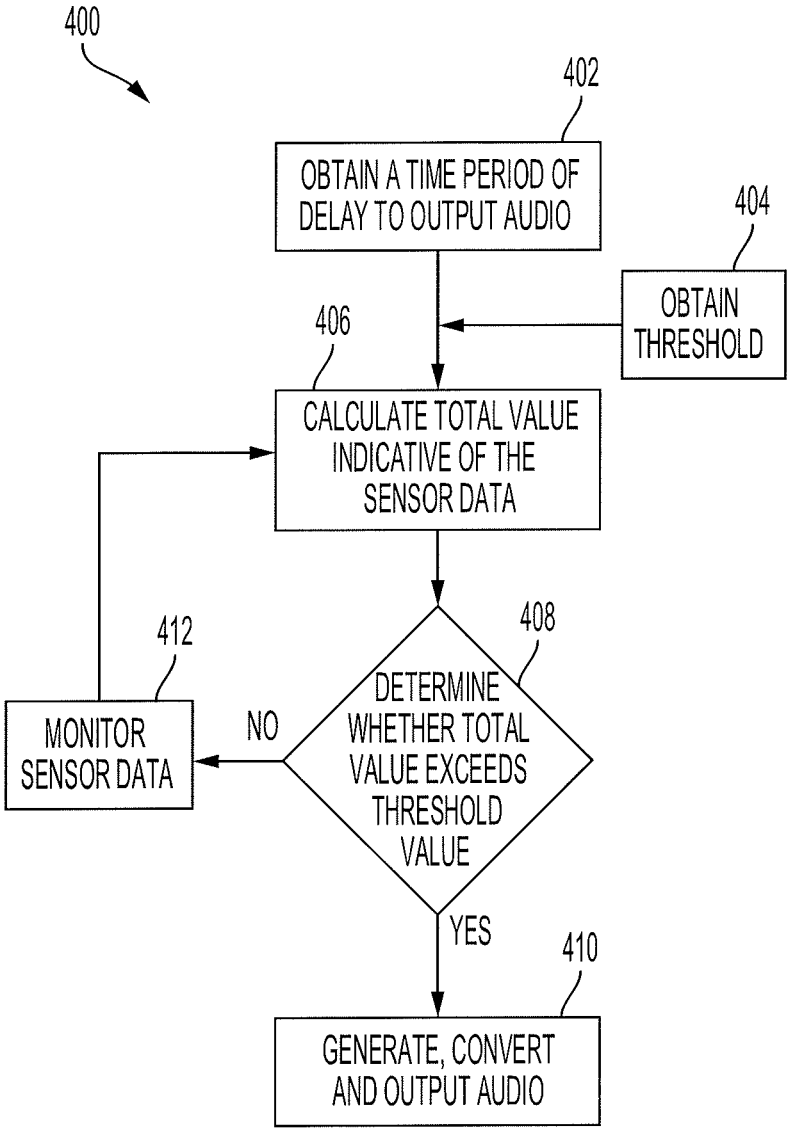
FIG. 4 shows a flow diagram of an example process for determining the timing of when to output the audio using the engine sound enhancement system of FIG. 1 according to an aspect of the invention.

By determining the timing, the audio may be outputted such that the outputted audio does not happen before enough air flows into the engine and there is enough engine torque to move the wheels of the vehicle 102. FIG. 4 further describes the process 400 for determining the timing of when to output the audio signal.

With the magnitude and the timing of when to output the audio signal determined, the sound enhancement system 100 generates the audio signal (216). The audio signal that is to be outputted may mimic or further enhance the engine sound of the vehicle 102. The sound enhancement system 100 may generate the audio signal based on the magnitude of the audio signal and the timing of when to output the audio signal. For example, the audio signal is generated when the timing is reached. The sound enhancement system 100 may delay the generation of the audio signal so that that the output of the audio coincides with and corresponds to the throttling of the engine 122, and subsequent, powering of the wheels of the vehicle 102. Thus, a more natural engine sound is outputted.

The sound enhancement system 100 may obtain or determine the type or kind of audio to be generated (218). The sound enhancement system 100 may obtain or download the type or kind of audio from the external database 104. The sound enhancement system 100 may select the type or kind of audio based on the type or kind of engine 122 and/or the type or kind of the vehicle 102. In some implementations, the sound to be generated may be pre-programmed or stored within the memory 108.

The sound enhancement system 100 converts the audio signal into audio and outputs the audio (220). The sound enhancement system 100 may use the audio device 112, such as an audio sound transducer, to convert the audio signal into audio and output the audio, such as via a speaker. For example, the magnitude of the audio signal may correspond to a volume for the audio. The magnitude of the audio signal and the volume of the audio may be directly proportional. As the magnitude of the audio signal increases, the volume of the audio also increases. And as the magnitude of the audio signal decreases, the volume of the audio also decreases.

FIG. 3 is a flow diagram of a process 300 for determining the magnitude of the audio signal, and consequently, the volume of the outputted audio. One or more computers or one or more data processing apparatuses, for example, the ECU 106 of the sound enhancement system 100 of FIG. 1, appropriately programmed, may implement the process 300.

The sound enhancement system 100 may assign or associate a value to each of the sensor data, such as the amount or the rate of airflow, the engine torque, the engine speed, the throttle position, the accelerator pedal position, the shift position and/or a combination thereof (302). The value of each of the sensor data may be based on the magnitude of the measurement or the position detected. For example, a greater amount or rate of airflow may correspond to a greater assigned value representative of the airflow and a lesser amount or the rate of the airflow corresponds to a lesser assigned value representative of the airflow. In another example, a greater engine speed corresponds to a greater assigned value representative of the engine speed and a lesser engine speed corresponds to a lesser assigned value representative of the engine speed.

The sound enhancement system 100 may weight the values indicative of the sensor data (304). The sound enhancement system 100 may prioritize or weight the values indicative of the sensor data. A greater weight may be associated and applied to the values indicative of the sensor data that is most representative of the magnitude of the audio signal. For example, since the amount of airflow and/or the rate of the airflow best corresponds and coincides with the natural engine sound of the engine 122 as it relates to the timing of the natural engine sound and the volume of the natural engine sound emitted, the sound enhancement system 100 may assign a greater weight to the value indicative of the amount of airflow and/or the rate of the airflow in comparison to the other sensor data, such as the position of the accelerator pedal, the engine torque, the engine speed and/or the engine throttle position.

Once each of the values indicative of the sensor data are weighted, the sound enhancement system 100 may calculate a total value indicative of the sensor data used to determine the magnitude and timing of the audio signal (306). The sound enhancement system 100 may calculate a total value based on a function of the values indicative of each of the sensor data and the weights associated with each of the sensor data. For example, each weight may correspond and be used as a multiplier of each value indicative of the corresponding sensor data. Then, the sound enhancement system 100 may sum the weighted values to form the total value indicative of the sensor data.

The sound enhancement system 100 determines the magnitude of the audio signal (308). The magnitude of the audio signal may be based on the total value indicative of the sensor data. The magnitude of the audio signal may directly correspond with the total value indicative of the sensor data. For example, a larger total value will correspond to a larger magnitude for the audio signal, which translates to a higher volume for the audio. In another example, a smaller total value will correspond to a smaller magnitude for the audio signal, which translates to a lower volume for the audio. The magnitude may be based on a mapping, which may be stored in the memory 108, between the total value and corresponding magnitudes.

In some implementations, the magnitude may be an average of the total value indicative of the sensor data over a period. This allows the sound enhancement system 100 to gradually and smoothly transition from one magnitude determined at one point of time and another magnitude determined at a subsequent point of time, which results in a steady transitioning of the audio when increasing or decreasing.

The sound enhancement system 100 converts the audio signal and outputs the audio that is converted from the audio signal, as described above (310). The sound enhancement system 100 may use an audio device 112 to convert the audio signal to audio, such as by using an audio sound transducer, and output the audio, such as by using a speaker. Once the audio is outputted, the sound enhancement system 100 may continue to monitor the sensor data (312). The sound enhancement system 100 may continue to monitor the sensor data to determine or detect any changes and continue the calculation and determination of the values of the audio signal to formulate any adjustments to the volume of the audio that is generated and outputted.

The sound enhancement system 100 may determine whether the sensor data has changed (314). The sound enhancement system 100 continues to generate the audio signal, convert the audio signal to audio and output the audio. When the sensor data has changed, the sound enhancement system 100 re-calculates each value indicative of each sensor data and re-calculates the total value of the sensor data to re-generate the audio signal and corresponding audio. When the sensor data has not changed, the sound enhancement system 100 continues to output the audio associated with the audio signal.

FIG. 4 further describes the process 400 for determining the timing of when to output the audio. One or more computers or one or more data processing apparatuses, for example, the ECU 106 of the sound enhancement system 100 of FIG. 1, appropriately programmed, may implement the process 400. Once the sound enhancement system 100 detects the sensor data, the sound enhancement system 100 may determine a timing of when to generate the audio signal and output the sound associated with the audio signal to match the powering of the wheels more closely of the vehicle 102. The timing may be a static delay and/or a dynamic delay that is based on the sensor data.

The sound enhancement system 100 may obtain a period of delay to output the audio that mimics or enhances the engine sound (402). The period of delay may be user-configured, pre-determined, such as a factory setting, user-inputted and/or calculated. The period of delay may be used to determine the timing of when to generate the audio signal and output the corresponding sound.

The sound enhancement system 100 may obtain a threshold value (404). The threshold value may represent the timing, e.g., a delay, of when to generate the audio signal, convert the audio signal to audio and output the audio. The threshold value may be user-inputted, pre-determined and/or obtained from the memory 108.

The sound enhancement system 100 may calculate the total value indicative of the sensor data, as described above (404). The sound enhancement system 100 may determine whether the total value exceeds the threshold value (408). The sound enhancement system 100 may compare the total value indicative of the sensor data to the threshold value.

When the total value exceeds the threshold value, e.g., greater than the threshold value, the sound enhancement system 100 generates the audio signal, converts the audio signal to audio, and outputs the audio, as described above (410). In some implementations, the sound enhancement system 100 may have already generated the audio signal and may only need to convert and output the audio. The timing of when the total value exceeds the threshold value may indicate that the engine 122 has been throttled enough to power and/or move the wheels of the vehicle 102. As such, the sound enhancement system 100 may generate the audio signal, convert the audio signal and/or output the audio to mimic or further enhance the engine sound. Since the output of the audio has been delayed until the total value exceeds the threshold value, the outputted audio coincides with the movement of the wheels. This creates a more natural engine sound.

Otherwise, when the total value does not exceed the threshold value, the sound enhancement system 100 may not generate the audio signal and/or output the audio. The sound enhancement system 100 may continue to monitor the sensor data until the calculated total value indicative of the sensor data exceeds the threshold (412).

In some implementations, the sound enhancement system 100 generates the audio signal, converts the audio signal and outputs the corresponding audio based on the period of delay. The sound enhancement system 100 delays the generation of the audio signal or the output of the audio for the period, and then, generates the audio signal and/or outputs the audio.

FIG. 5 shows a graph 500 comparing various sensor data, which may be used by the engine sound enhancement system of FIG. 1, to output the audio that mimics or enhances the engine sound. The line 502 represents the amount and/or rate of the airflow of the engine intake air that enters the engine 122. The amount and/or rate of the engine intake air, as represented by the line 502, better corresponds to and coincides with the vehicle behavior and/or response than the other sensor data. As shown in FIG. 5, the line 504 represents the sound or audio generated using measurements from the amount and/or rate airflow that enters the engine 122, as shown in line 502. As can be seen in FIG. 5, the slope of line 504 better matches and corresponds to the increase in the engine speed, represented by line 512, and consequently, better matches and corresponds to the acceleration in the vehicle speed throughout the entire period in comparison to the other factors, such as the pedal angle position and the throttle angle position.

FIG. 5 also shows the relationship between the pedal angle position and the throttle angle position with the engine speed. The line 506 represents the pedal angle position and the line 508 represents the audio or sound generated that corresponds to the input of the pedal angle position. Both lines 506, 508 exhibit an initial steep curve around the 2 second mark. The initial steep curves of the pedal angle position and the corresponding audio generated have a greater angled slope than that of the engine speed, which is represented by the line 512. Moreover, the slope of lines 506, 508 is greater than the slope of lines 502, 504, and so, the amount and/or rate of airflow and the corresponding audio generated is more reflective of the vehicle response, as shown by line 512 which represents the engine speed.

If the sound enhancement system 100 uses the pedal angle position as the only input, the outputted sound would occur almost immediately and without delay. The outputted sound would not gradually ramp up with a steady slope consistent with the engine speed, but instead, would have a much greater slope and reach a peak more quickly, which would translate to a less gradual and more abrupt or sudden increase in volume of the outputted audio. And thus, the outputted audio would be inconsistent with the vehicle behavior and/or response.

Similarly, line 510 represents the audio generated using the throttle angle position. The line 510 has a similar steep curve which has a greater angled slope than that of the amount and/or the rate of the engine intake air and/or the engine speed. Thus, if the sound enhancement system 100 were to solely use the throttle angle position as the only input to generate the audio signal, the outputted audio would be inconsistent with the volume of the engine sound that would naturally occur and be outputted at the engine speed. Similarly, the outputted sound would occur almost immediately and without delay if the throttle angle position were to be used as the only input, which would be inconsistent with the vehicle behavior.

In some implementations, the sound enhancement system 100 may use a combination of measured amount and/or rate of the airflow along with the other sensor data to generate an audio signal that better matches the vehicle behavior. The various sensor data may be weighted to further improve the preciseness and accuracy of the audio signal in comparison to a natural engine sound and to match the corresponding vehicle behavior and response.

FIG. 6 shows an example graph of the effect of a downshift of the shift position of the transmission 124 on the generation of the audio using the engine sound enhancement system of FIG. 1. The line 602 represents the shift position of the transmission 124 of the vehicle 102. At approximately the 3.75 s mark represented as point 604, the transmission 124 downshifts. One or more paddle shifters 126 may have received user input that indicates a paddle downshift. By downshifting, the transmission 124 transitions to a lower gear and flares the engine speed, which may be represented by line 606 and may increase the engine speed and airflow into the engine 122. The sound enhancement system 100 better reflects the vehicle behavior when using the measurement of the amount and/or the rate of the airflow, as shown in line 610 for example. Line 608 shows the audio outputted when using measurements from the amount and/or the rate of the airflow and better reflects the line 606 that represents the engine speed in comparison to other factors. For example, the line 612, which represents the audio generated based on the pedal angle position, only shows a minimal change when the downshift occurs.

When the one or more paddle shifters 126 downshift the shift position of the transmission 124, the amount of airflow into the engine 122 may increase and the corresponding audio generated and outputted may also increase, as represented by lines 610 and 608, respectively. The one or more paddle shifters 126 downshift the position at point 604, and as a result, the amount and/or rate of the airflow may increase at point 614, which indicates an increase of the airflow into the engine 122. Thus, the sound enhancement system 100 may adjust the outputted audio to reflect the downshift by increasing the magnitude of the audio signal that is to be generated, converted and outputted as audio to mimic or enhance the engine sound, as shown at point 616, due to the increased airflow and resulting increase in engine torque to match the vehicle behavior and/or response.

When the one or more paddle shifters 126 upshift the shift position of the transmission 124, the amount of airflow into the engine 122 may decrease, and as a result, the amount and/or rate of the airflow may decrease. Thus, the sound enhancement system 100 may adjust the audio to reflect the upshift by decreasing the magnitude of the audio signal that is to be generated, converted and outputted as audio to mimic the engine sound due to the decreased airflow and resulting decrease in engine torque to match the vehicle behavior and/or response.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A sound enhancement system for a vehicle, comprising:
- an airflow sensor configured to measure an airflow into an engine of the vehicle;
- an electronic control unit coupled to the airflow sensor and configured to:
  - determine an amount or a rate of the airflow that enters the engine of the vehicle,
  - determine a timing of when to output an audio signal that mimics or enhances engine sound based on when the amount or the rate of the airflow that enters the engine of the vehicle exceeds a threshold amount or rate, and
  - generate the audio signal based on the airflow into the engine of the vehicle; and
- an audio device configured to output the audio signal based on the determined timing of when to output the audio signal.

2. The sound enhancement system of claim 1, further comprising:
- a speed sensor configured to measure a rotation speed of the engine of the vehicle; and
- a throttle sensor configured to detect a position of an engine throttle;
- wherein the electronic control unit is configured to generate the audio signal further based on the rotation speed of the engine of the vehicle and the position of the engine throttle.

3. The sound enhancement system of claim 1, further comprising:
- an accelerator pedal sensor configured to measure a position of an accelerator pedal of the vehicle;
- wherein the electronic control unit is configured to generate the audio signal further based on the position of the accelerator pedal.

4. The sound enhancement system of claim 1, further comprising:

one or more paddle shifters configured to upshift or downshift a gear of a transmission of the vehicle into a shift position;

wherein the electronic control unit is configured to generate the audio signal further based on the shift position.

5. The sound enhancement system of claim 1, wherein the electronic control unit is configured to determine a magnitude of the audio signal, wherein an increase in the airflow into the engine corresponds to an increase in the magnitude of the audio signal and a decrease in the airflow into the engine corresponds to a decrease in the magnitude of the audio signal.

6. The sound enhancement system of claim 5, wherein the audio device is a speaker in an interior of the vehicle and the speaker is configured to output sound converted from the audio signal into the interior of the vehicle.

7. The sound enhancement system of claim 6, wherein the increase in the magnitude of the audio signal corresponds to an increase in a volume of the outputted sound via the speaker and the decrease in the magnitude of the audio signal corresponds to a decrease in the volume of the outputted sound via the speaker.

8. The sound enhancement system of claim 1, wherein the electronic control unit is configured to:

determine that the audio signal should be outputted when the amount or the rate of the airflow that enters the engine of the vehicle exceeds the threshold amount or rate.

9. The sound enhancement system of claim 1, wherein the audio signal is generated independently of a depression of an accelerator pedal of the vehicle.

10. An engine sound enhancement system for a vehicle, comprising:

an airflow sensor configured to measure an airflow into an engine of the vehicle;

an electronic control unit coupled to the airflow sensor and configured to:

determine a magnitude of an audio signal that mimics or enhances engine sound of the vehicle to be outputted based on the airflow into the engine, determine an amount or a rate of the airflow that enters the engine of the vehicle, determine a timing of when to output the audio signal based on when the amount or the rate of the airflow that enters the engine of the vehicle exceeds a threshold amount or rate, and generate the audio signal based on the determined magnitude; and a speaker positioned within an interior of the vehicle and configured to output the audio signal based on the determined timing of when to output the audio signal.

11. The engine sound enhancement system of claim 10, wherein the audio signal is generated independently of a depression of an accelerator pedal of the vehicle.

12. The engine sound enhancement system of claim 10, further comprising:

a speed sensor configured to measure a rotation speed of the engine of the vehicle; and a torque sensor configured to measure an amount of engine torque;

wherein the electronic control unit is configured to determine the magnitude of the audio signal further based on the rotation speed of the engine of the vehicle and the amount of engine torque.

13. The engine sound enhancement system of claim 10, further comprising:

an accelerator pedal sensor configured to measure a position of an accelerator pedal of the vehicle;

wherein the electronic control unit is configured to determine the magnitude of the audio signal further based on the position of the accelerator pedal.

14. The engine sound enhancement system of claim 10, further comprising:

one or more paddle shifters configured to upshift or downshift a gear of a transmission of the vehicle into a shift position;

wherein the electronic control unit is configured to determine the magnitude of the audio signal further based on the gear of the transmission.

15. The engine sound enhancement system of claim 10, wherein an increase in the airflow into the engine corresponds to an increase in the magnitude of the audio signal and a decrease in the airflow into the engine corresponds to a decrease in the magnitude of the audio signal.

16. The engine sound enhancement system of claim 10, wherein an increase in the magnitude of the audio signal corresponds to an increase in a volume of the outputted audio signal via the speaker and a decrease in the magnitude of the audio signal corresponds to a decrease in the volume of the outputted audio signal via the speaker.

17. The engine sound enhancement system of claim 10, wherein the electronic control unit is configured to:

determine that the audio signal should be outputted when the amount or the rate of the airflow that enters the engine of the vehicle exceeds the threshold amount or rate.

18. A method for outputting an engine sound, comprising:

measuring, using an airflow sensor, an amount or a rate of an airflow into an engine of a vehicle;

determining, by a processor, a magnitude of an audio signal that is to be generated and that mimics or enhances engine sound of the vehicle based on the amount or the rate of the airflow into the engine;

determining, by the processor, a timing of when to output the audio signal based on when the amount or the rate of the airflow into the engine of the vehicle exceeds a threshold amount or rate;

generating, by the processor, the audio signal based on the determined magnitude; and outputting, via a speaker positioned within an interior of the vehicle, the audio signal based on the determined timing of when to output the audio signal.

19. The method of claim 18, further comprising:

obtaining, by the processor and from one or more paddle shifters, one or more signals to change a shift position of a gear of a transmission of the vehicle; and determining, by the processor, the magnitude of the audio signal further based on the shift position of the gear of the transmission.

20. The method of claim 18, wherein the audio signal is generated independently of a depression of an accelerator pedal of the vehicle.

* * * * *